United States Patent [19]

Baldwin et al.

[11] 4,028,219

[45] June 7, 1977

[54] PROCESS FOR THE PRODUCTION OF DEASHED COAL LIQUIFACTION PRODUCTS

[75] Inventors: Roger Allen Baldwin; Robert Elliott Davis, both of Oklahoma City, Okla.

[73] Assignee: Kerr-McGee Corporation, Oklahoma City, Okla.

[22] Filed: Oct. 23, 1975

[21] Appl. No.: 625,206

[52] U.S. Cl. ..... 208/8; 208/96; 208/251 R

[51] Int. Cl.[2] ..... C10G 1/04

[58] Field of Search ..... 208/8, 10, 96

[56] References Cited

UNITED STATES PATENTS

| | | | |
|---|---|---|---|
| 2,871,181 | 1/1959 | Kulik | 208/8 |
| 2,989,458 | 6/1961 | Kulik | 208/8 |
| 3,010,893 | 11/1961 | Kulik | 208/8 |
| 3,075,912 | 1/1963 | Eastman et al. | 208/8 |
| 3,598,718 | 8/1971 | Gleim et al. | 208/8 |
| 3,852,183 | 12/1974 | Snell | 208/10 |

*Primary Examiner*—Herbert Levine
*Attorney, Agent, or Firm*—William G. Addison

[57] ABSTRACT

This invention relates to an improved process for the production of deashed coal which includes contacting coal with coal dissolving solvent at elevated temperature and pressure in a hydrogen atmosphere and thereafter passing the resulting mixture to a vacuum tower to remove coal dissolving solvent for recirculation and leave vacuum tower still bottoms, which are substantially free of coal dissolving solvent. Said still bottoms then are contacted with a solubilizing solvent to dissolve a substantial quantity of said still bottoms after which said dissolved still bottoms are separated from undissolved still bottoms. The separation procedure may be effected by settling, countercurrent decantation, or filtration using pressure precoated rotary and plate filters and the like.

10 Claims, 2 Drawing Figures

PROCESS FOR THE PRODUCTION OF DEASHED COAL LIQUIFACTION PRODUCTS

BACKGROUND OF THE INVENTION

Considerable research and development effort currently is underway in an effort to develop commercially practical processes for upgrading raw coals (bituminous, subbituminous and lignite) to provide a more ecologically acceptable product, i.e., one with both a low sulfur and a low ash content.

Various proceses, including gasification, liquefaction, pyrolytic and combinations of these processes have been investigated. One promising process, solvent extraction, comprises dissolving ground coal in solvent, in the presence of hydrogen, to provide a mixture consisting of dissolved coal, in solution, as well as solid insoluble coal values and mineral matter or ash. Separation of the dissolved coal from the insoluble materials has proved to be arduous and costly when attempted by either filtration or with the use of hydroclones.

Moreover, even when such separation attempts have been successful, the ash content of the separated dissolved coal has been found to be higher then desired. An ash content of 0.16 weight percent or less in the dissolved coal is desirable since, with such a low ash level, it would be possible to burn such low ash coal in electric power plants or the like without the necessity of adding costly fly-ash removal equipment for the stack-gases.

It also has been found that when filters or hydroclones are used as separation devices that an undesirable quantity of dissolved coal remains either in the filter cake or hydroclone underflow with the ash. In this connection, while it is recognized that carbon values are required for the generation of hydrogen used in the initial coal dissolving step, such filter cake or hydroclone underflow is so high in dissolved coal that it is not practical to use such a valuable product as a feed for a hydrogen generation plant. Further, hydroclones fail to remove sufficient ash to meet the desired 0.16 weight percent ash level for the dashed coal.

Many prior art processes have been found to be impractical. Some depend upon the utilization of unusual or especially prepared coal dissolving solvents. See for example U.S. Pat. No. 3,867,275. Further, such dissolving solvents frequently are generated from various petroleum fractions rather than being derived from coal. clearly, coal derived solvent is preferred to one derived from petroleum.

Other prior art processes have proved to be economically unsuitable because they require treatment of the entire dissolved effluent with a second liquid intended to enhance or promote separation of unsuitable materials from the dissolved coal. One disadvantage of such processes lies in the fact that large volumes of effluent have to be treated. This can be understood from the fact that two to three or more parts of dissolving solvents must be employed for each part of more virulent coal dissolved in the initial dissolution step. In one prior art process, a special kerosine compound is prepared via a controlled hydrogenation step. See U.S. Pat. No. 3,852,182; 3,852,183 and 3,856,675. Use of such solvents requires relatively long settling rates. Another process, U.S. Pat. 3,791,956, requires the use of solvents such as n-decane, cyclohexane or decalin, all of which are expensive and result in processes which do not appear to be economical.

Successful processes for the deashing of coal utilizing critical pressure solvent techniques are disclosed in U.S. Pat. Nos. 3,607,716 and 3,607,717. In such processes, following the initial dissolution of particulate coal in suitable solvents, in the presence of hydrogen, and at elevated temperatures and pressures, gaseous products and very light hydrocarbon fractions are separated from the dissolver effluent which then is advanced directly to a vacuum stripping tower. Overheads from that tower can be fractionated to yield light hydrocarbons and process solvent which may be recycled to the dissolving step. Bottoms from the vacuum tower, which still contain the mineral ash, undissolved coal and dissolved coal, then are subjected to critical pressure solvent deashing utilizing light organic solvents. Under suitable conditions of elevated temperature and pressure a heavy, ash-containing phase separates from a light substantially ash-free coal phase. The phases are separated, of course, and further treated as desired.

SUMMARY OF THE INVENTION

It now has been discovered that it is possible to admix the bottoms from the vacuum tower with certain specified solvents and thereafter separate ash materials and insoluble coal products from the resulting coal solution by settling, countercurrent decantation or filtration using pressure precoated rotatry and plate filters. The resulting countercurrent decantation overflow or filtrate stream then is heated to flash remove the dissolving solvent and leave a dissolved coal solution having a mineral ash content of 0.5 weight percent or less.

DESCRIPTION OF PREFERRED EMBODIMENTS

Figure 1:
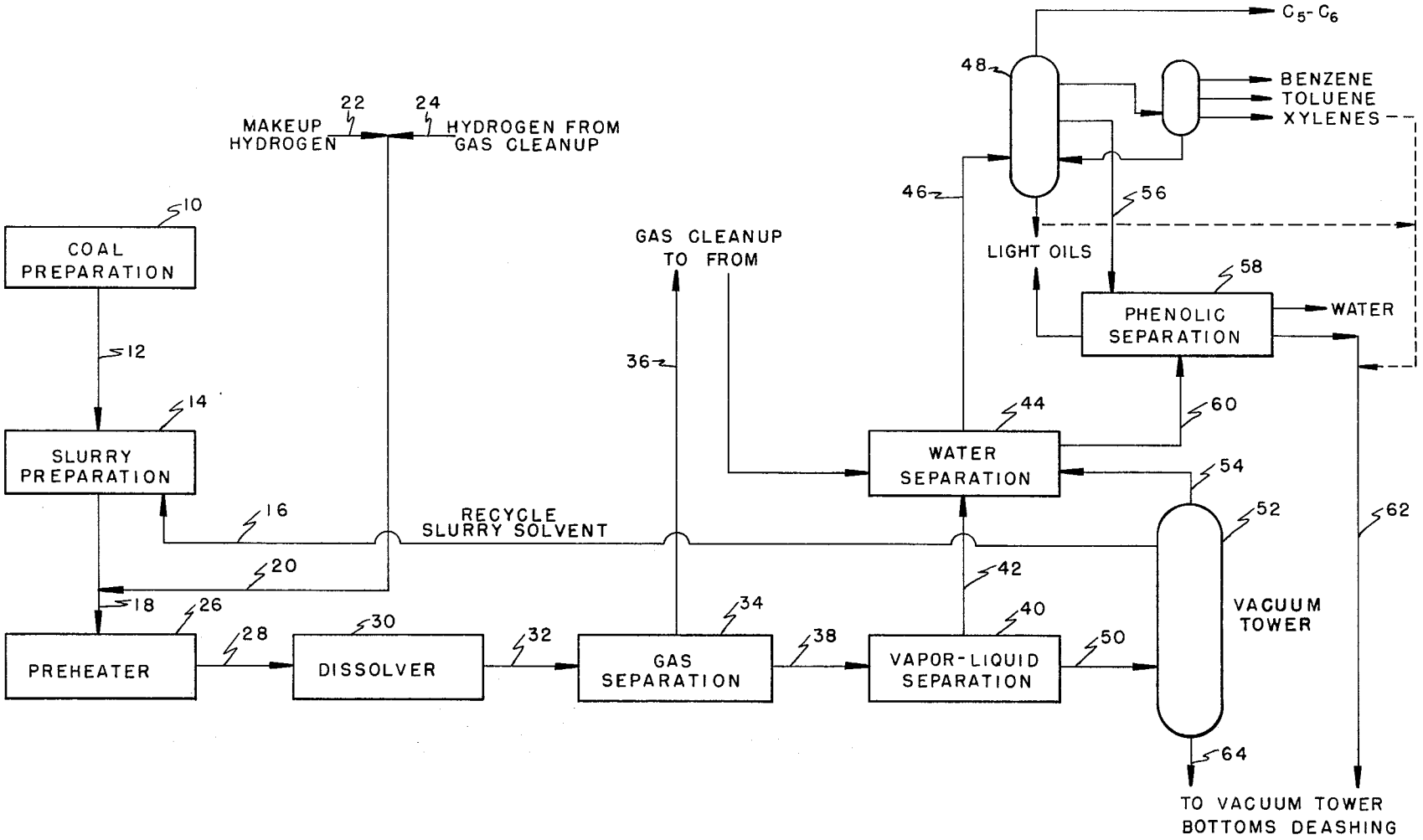
FIG. 1 is a schematic illustration of a process for dissolving coal.

Looking at FIG. 1 of the drawing, there is illustrated a tank 10 in which coal, dried to less than about three weight percent moisture and ground to less than about one-eight inch, preferably about −100 mesh or less, is stored. Ground coal is conveyed through line 12 to slurry preparation vessel 14 wherein it is admixed with recycle solvent introduced through line 16. If desired, the recycle solvent may be catalytically hydrogenated, by known processes, to increase its content of hydrogen donor compounds.

The slurry of ground coal and recycle solvent is heated to about 350° to about 450° F in slurry preparation vessel 14 to obtain desired pumping characteristics. The weight ratio of solvent to coal should be within the range of from about two to about six, preferably from about 2.5 to 4. The warm slurry of coal and solvent is advanced under pressure through line 18. The slurry is mixed with pressurized hydrogen introduced through line 20 comprising either makeup hydrogen introduced through line 22 or hydrogen recovered and recycled through line 24 from the off-gas clean up plant. If desired, synthesis gas, which is a mixture of hydrogen and carbon monoxide, may be used instead of hydrogen. The hydrogen-containing coal slurry then is passed into a preheater 26 wherein it is heated to a temperature of about 750° to about 850°

F. The system pressure may range from about 1000 to about 5000 psig.

The preheated and pressurized slurry then is conveyed through line 28 to a dissolver vessel 30. In that vessel, which is operated at about 750° to about 850° F, a large portion of the coal values are dissolved in the solvent. Residence time in the dissolver vessel may vary from 5 to 60 minutes, generally about 30 to 45 minutes. The pressure in the vessel preferably is maintained within about 1250 to about 3000 psig.

The resultant slurry then is conveyed through line 32 to a high pressure gas separation vessel 34. Excess hydrogen, oxides of carbon, hydrogen sulfide and other gaseous coal conversion products are separated in vessel 34 and conveyed through line 36 to a gas clean up plant, not shown, for recovering hydrogen for recycle in the system. The gas separator vessel is operated at a pressure of about 1000 to about 2500 psig.

The gas-free coal slurry then is conveyed from separator 34 through line 38 to a vapor-liquid separation vessel 40. That vessel is operated at temperatures up to about 600° F and at pressures as low as atmospheric. Light liquids separate in vessel 40 and are conveyed through line 42 to a water separation vessel 44 and then through line 46 to a light liquids fractionating column 48.

The slurry of coal remaining in separation vessel 40 is conveyed through line 50 to a solvent recovery tower 52 operated under vacuum, e.g., at a pressure of from about 2 to about 5 psig and a temperature of about 500° to about 600° F. Light liquids are recovered to tower 52 and are conveyed through line 54 to the water separator 44 and then to light liquids separation unit 48. The hot vacuum tower bottoms which contain the mineral ash and insoluble components of the feed coal then are advanced to the deashing unit shown in FIG. 2 via line 64.

The feeds to light liquids separation unit 48 are separated, by means outside the scope of this invention, into a number of products such as pentane, benzene, toluene, xylenes and other distillates boiling between 400° and 550° F. A phenolics rich fraction is withdrawn from the separation unit 48 through line 56 and introduced into a phenolic separator unit 58. Water from separator 44 is conveyed through line 60 and introduced into the phenolic separation unit 58. A mixture of phenol., cresols and xylenols is separated and conveyed through line 62 to the deashing unit illustrated in FIG. 2. The foregoing procedure for dissolving coal is set forth by way of illustrating only one of several suitable coal dissolution methods which can be used in practicing the present invention. Another suitable solubilizing procedure is that including an ebullated bed of particulate catalyst.

Figure 2:
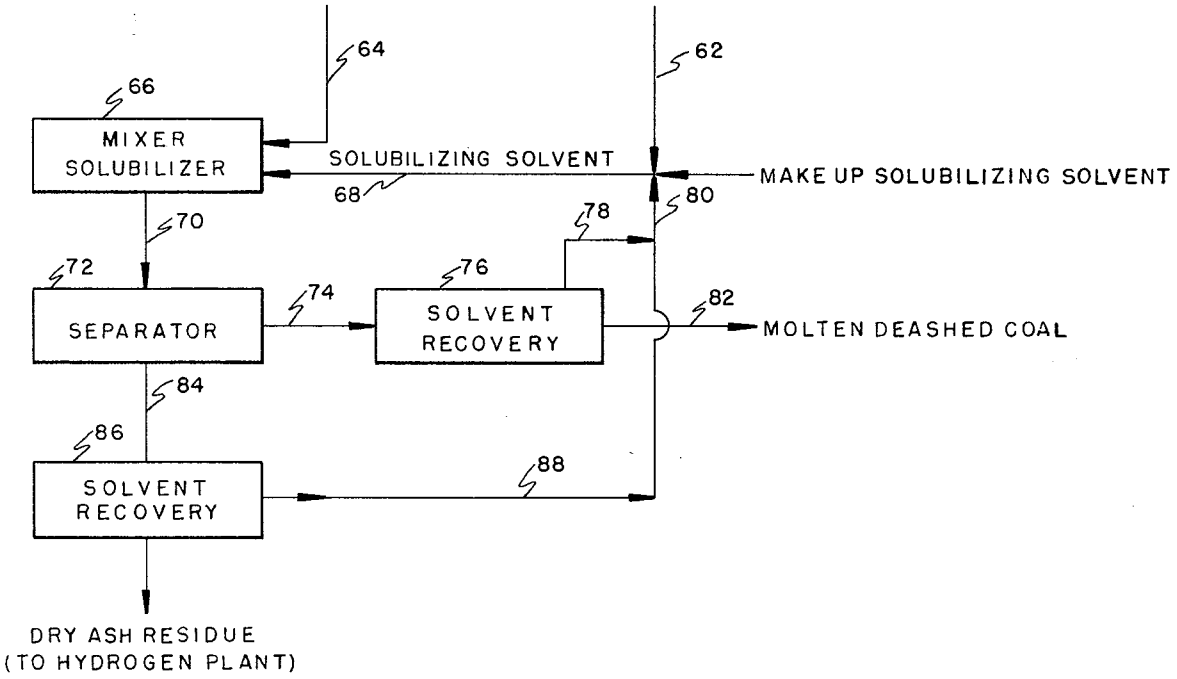
FIG. 2 is a schematic illustration of a process for removing insoluble materials, including ash, from admixture with dissolved coal in vacuum tower bottoms.

Turning now to FIG. 2 of the drawings, the ash-containing vacuum tower bottoms are passed through line 64 into a mixing-solubilization zone 66. Solubilizing solvent is introduced into zone 66 through line 68. That solubilizing solvent will be defined in greater detail hereinafter.

The ash-containing vaccum tower bottoms and solubilization solvent are contacted for up to 2 hours in zone 66 to effect the dissolution of a maximum quantity of the coal values present in the bottoms. The temperature in zone 66 may range from about 190° to 400° F and at sufficient pressure to maintain the solvent in liquid state. A slurry of mineral ash and undissolved coal suspended in a solution of solubilizing solvent containing dissolved coal values is passed from zone 66 through line 70 into a separator 72. Examples of suitable separating units include countercurrent decant circuits, precoat rotary filters, plate filters and the like.

If separator 72 is a filter, the filtrate comprises an ash lean stream of dissolved coal and solvent which is conveyed through line 74 to a solvent recovery station 76 such as a distillation tower or a critical pressure solvent fractionation unit. Solvent recovered in station 76 is returned through line 78 and 80 to line 68 for recycle to the mixer-solubilizer 66. The product, a molten (about 450° to about 550° F) stream of deashed coal containing less than 0.5 weight percent ash, is withdrawn through line 82.

The ash separated in separator 72 is conveyed through line 84 to a second solvent recovery station 86. The ash is first washed in station 86 to remove any entrained dissolved coal values after which the washed solvent may be flashed and recovered for recycle through lines 88 and 80 to the mixer-solubilizer 66. If the quantity of dissolved coal associated with the ash is quite low, the solubilization solvent may be flashed directly from the ash without a prior washing step. The dry ash concentrate exiting from solvent recovery unit 86 then conveniently is fed to a hydrogen plant, not shown, wherein its carbon and hydrogen values may be utilized in the production of process hydrogen.

Solvents which are suitable for use in accordance with the present invention are coal derived solvents and comprise at least one selected from the group consisting of phenolics, alkylnaphthalenes, polyalkylbenzenes and aliphatic heterocyclic aromatic compounds.

Examples of suitable phenolics include phenol; o-cresol; m-cresol; p-cresol; 2,4-xylenol and mixtures thereof.

Examples of suitable alkylnaphthalenes include 1-methyl naphthalene; 2-methyl naphthalene; 2,3-dimethylnaphthalene and mixtures thereof.

Examples of polyalkylbenzenes include o-xylene; m-xylene; p-xylene; o-cymene; m-cymene; p-cymene; mesitylene; hemimellitene; pseudo-cumene, and mixtures thereof.

Examples of heterocyclic aromatic compounds include quinoline; carbazole, 2,3-dimethylquinoline; 2-methylquinoline; 3-methylquinoline; 6-methylquinoline and mixtures thereof.

Examples of suitable pyridine compounds include pyridene; 2-ethyl pyridine; 4-ethyl pyridine; 2-methyl pyridine; 4-methyl pyridine; 2,4-lutidine; 2,6-lutidine; 3,4-lutidine, and mixtures thereof.

To illustrate the invention even more particularly, the following specific examples are set forth. These examples are included for illustrative purposes only and are not intended to limit the scope of this invention which, of course, is defined solely by the appended claims.

These examples illustrate the importance of the particular solvent used in this invention in regard to the effective separation of mineral ash values from coal derived vacuum tower bottoms.

Table 1 below sets forth data from 12 Examples illustrating the ability of various solvents to dissolve coal. Three different coal feeds were used. The solubilities were determined using a Soxhlet apparatus and procedure as described in *GENERAL LABORATORY TECHNIQUES* by Philip Perlman, MS, 1964, Franklin Pulishing Company, Inc., pages 134–135, incorporated herein by reference. More particularly, in each of the Examples, about 10 grams of finely divided coal were placed in a porous thimble which, in turn, was placed in the Soxhlet apparatus. One hundred fifty grams of the selected solvent were placed in the flask and heated.

Vaporized solvent passed upwardly through the apparatus where it was condensed and allowed to drip downwardly onto the coal maintained in the thimble. Dissolved coal and solvent "weeped" through the side wall of the thimble and collected in the apparatus until it overflowed the syphon and flowed downwardly to collect in the flask. Solids remained in the thimble. Ash extraction was continued for a period of time specified in the Table.

The feed used in Examples 1–7 comprised vacuum tower bottoms obtaind by noncatalytic dissolution of a blend of Kentucky No. 9 and 14 coals (feed B). The feed (feed A) used in Examples 8–11 comprised vacuum tower bottoms obtained from catalytic dissolution of Illinois No. 6 coal. The feed (feed C) used in Example 12 comprised vacuum tower bottoms from noncatalytic conversion of Illinois No. 6 coal.

The results for Examples 1–4 show that over a period of 89 hours a maximum of 58.8 weight percent of feed B was dissolved. On the other hand, as shown by Example 8, only a period of 24 hours was required to dissolve 60.8 weight percent of feed A. Moreover, it will be noted that feeds B and C (even though similar in ash content, viz., 20.8 weight percent and 23.1 weight percent ash, respectively, and both generated from Illinois No. 6 coal) gave substantially different solubilities in benzene. More particularly, compare Examples 8–10 with Example 12. It is significant to note that the data in the Table shows that the solvents of the present invention, namely mixed xylenes and pyridine, (Examples 6 and 7) are much better solvents than is benzene. An attempt was made in Example 5 to determine if benzene would be a more effective solvent if the extraction were repeated three times. The data in the Table show that, even under those conditions, only 58.8 weight percent of the feed dissolved in benzene.

TABLE I

SOLUBILITIES OF ASH-CONTAINING VACUUM TOWER BOTTOMS
-VIA SOXHLET EXTRACTION-

| Ex. No. | Solvent | Hours Extracted | Ash, Wt. % in Feed | Wt. % of Feed Dissolved |
|---|---|---|---|---|
| 1 | Benzene | 38 | 13.4[a] | 37.5 |
| 2 | Benzene | 69 | 13.4[a] | 49.6 |
| 3 | Benzene (under $N_2$) | 72 | 13.4[a] | 50.8 |
| 4 | Benzene | 89 | 13.4[a] | 58.8 |
| 5 | Benzene[d] | 28 | 13.4[a] | 37.5 |
| | | 54 | — | 58.8 |
| | | 90 | — | 60.7 |

TABLE I-continued

SOLUBILITIES OF ASH-CONTAINING VACUUM TOWER BOTTOMS
-VIA SOXHLET EXTRACTION-

| Ex. No. | Solvent | Hours Extracted | Ash, Wt. % in Feed | Wt. % of Feed Dissolved |
|---|---|---|---|---|
| 6 | Mixed xylenes | 72 | 13.4[a] | 80.6 |
| 7 | Pyridine | 26 | 13.4[a] | 80.6 |
| 8 | Benzene | 24 | 20.8[b] | 60.8 |
| 9 | Benzene | 47 | 20.8[b] | 57.2 |
| 10 | Benzene | 70 | 20.8[b] | 57.4 |
| 11 | Pyridine | 70 | 20.8[b] | 69.5 |
| 12 | Benzene | 90 | 23.1[c] | 38.0 |

[a]Vacuum tower bottoms obtained from noncatalytic dissolution of a blend of Kentucky No. 9 and 14 coals (feed B).
[b]Vacuum tower bottoms obtained from noncatalytic dissolution of Illinois No. 6 coal (feed A).
[c]Vaccum tower bottoms obtained from catalytic conversion of Illinois No. 6 coal (feed C).
[d]After initial extraction period, sample withdrawn, dried, weighed, ground up, and returned for additional extraction.

Table II contains the results of Examples 13–31. Solubilities of feeds A and B are set forth, as indicated, by bench top digestions utilizing a variety of pure and mixed solvents. Two type B feeds were investigated; one contained 13.4 and the other contained 10.8 weight percent mineral ash.

In conducting these disgestions, as shown in Table II, there is recorded the particular solvent used, the time, temperature and weight ratio of solvent to coal. Following the digestion, the mixture was filtered at the same temperature as that of the digestion. The filter cake obtained was washed with acetone to remove the solvent, dried and analyzed for its ash content. More particularly, in carrying out the bench top digestions, 50 grams of the respective coal feeds were mixed with 500 grams of the indicated solvent in a flask. The contents were heated to the temperatures and for the periods of time indicated in Table II. Thereafter, the contents of the flask were filtered. The filtrate comprised essentially ash-free liquid coal and solvent. The filter cake contained mineral ash and undissolved coal. In each Example the filter cake was weighed and analyzed for its ash content. Clearly, the better solvents dissolved more of the coal, leaving less insoluble coal in the filter cake, thereby causing the percent ash to be higher. Therefore, the data set forth in the last column of Table II indicates that the higher the number, the more effective the solvent. Again, xylenes and pyridines are shown to be superior to the other solvents tested.

TABLE II

SOLUBILITIES OF ASH-CONTAINING VACUUM TOWER BOTTOMS
-VIA BENCH TOP DIGESTIONS-

| Example No. | Solvent | Hours Digested | Temp. °F | Sol./Feed Wt. ratio | Ash Wt.%[d] Before | Ash Wt.%[d] After |
|---|---|---|---|---|---|---|
| 13 | Benzene | 1.25 | 77 | 5 | 13.4 | 17.3 |
| 14 | Benzene | 1.25 | 172 | 5 | 13.4 | 23.6 |
| 15 | 50% Benzene-50% cresols[b] | 1.25 | 226 | 5 | 13.4 | 48.4 |
| 16[a] | 31% Benzene-69% cresols[b] | 1.25 | 230 | 5 | [a]13.4 | 40.5 |
| [b] | | | | | [b]13.4 | 54.0 |
| 17 | Cresols[b] | 1.25 | 392 | 5 | 13.4 | 62.9 |
| | | 1.25 | 392 | 6.5 | 13.4 | 68.0 |
| 18 | 50% Xylenes-50% cresols[c] | | 309 | 5 | 10.9 | 59.6 |
| | | 1.25 | 320 | 3 | 10.8 | 60.2 |
| 19 | 1-Hexanol | 1 | 284 | 5 | 10.8 | 27.4 |
| 20 | Triethylamine | 1 | 190 | 5 | 10.8 | 16.4 |
| 21 | Triethylamine | 1 | 190 | 5 | 20.8 | 34.8 |
| 22 | Tetrahydrofuran | 1 | 150 | 5 | 10.8 | 51.6 |
| 23 | Tetrahydrofuran | 1 | 150 | 5 | 20.8 | 59.4 |
| 24 | n-Butylacetate | 1 | 240 | 5 | 10.8 | 55.25 |
| 25 | n-Butylacetate | 1 | 240 | 5 | 20.8 | 40.1 |

TABLE II-continued

SOLUBILITIES OF ASH-CONTAINING VACUUM TOWER BOTTOMS -VIA BENCH TOP DIGESTIONS-

| Example No. | Solvent | Hours Digested | Temp. ° F | Sol./Feed Wt. ratio | Ash Wt.%[d] Before | After |
|---|---|---|---|---|---|---|
| 26 | 1-Methyl naphthalene | 3 | 410 | 4.3 | 13.4 | 42.5 |
| 27 | 1-Methyl naphthalene | 1 | 410 | 5 | 20.8 | 55.3 |
| 28 | Pyridine | 2 | 239 | 5.2 | 20.8 | 64.8 |
| 29 | Pyridine | 1 | 239 | 5.1 | 20.8 | 64.6 |
| 30 | Methyl-isobutyl ketone | 2 | 239 | 5 | 10.8 | 26.1 |
| 31 | Acetone | 1 | 122 | 5 | 20.8 | 40.0 |

[a]In Example 16a, the digestion mixture was cooled to ambient temperature prior to filtering; in Example 16b, the filtration was at the digestion temperature.
[b]Composition of cresols: 82.9% p-cresol and 17.1% m-cresol (by weight).
[c]Composition of cresols: 48.9% m-cresol; 11.3% p-cresol; 24.0% 2,4-dimethyl phenol; 7.8% 3,4-dimethyl phenol; and 7.8% catechol (by weight).
[d]Feed A containing 20.8 weight percent mineral ash was obtained from the catalytic conversion of Illinois No. 6 coal. Feed B was obtained via the noncatalytic conversion of blends of Kentucky No. 9 and 14 coals and two ash-containing vacuum tower bottoms (10.8 and 13.4 weight percent ash) were investigated.

Table III sets forth the results of Examples 32–36 which were performed to evaluate the possible effects of elevated temperatures and pressures on the solubilization of a portion of the coal values contained in the ash-containing vacuum tower bottoms. These tests were carried out in a rocked 1-liter Parr autoclave. Each experiment was carried out for the period of time set forth in the Table, after which the autoclave was cooled to room temperature and opened. The resulting slurry was filtered and the filter cake was washed with benzene and then vacuum dried. The dried filter cake then was analyzed and found to have the ash content set forth in the Table. The data obtained in Examples 32–35 as compared with that obtained in the bench top digestions, Examples 15 and 16, demonstrate that there is no particular advantage to be gained by operating the process at elevated temperatures and pressures.

TABLE III

SOLUBILITIES OF ASH-CONTAINING VACUUM TOWER BOTTOMS -EFFECT OF TEMPERATURE AND PRESSURE-

| Conditions: Example No. | 380–400° F Autogenic pressure 5/1 solvent to coal weight ratio 1 hour at temperature Solvent (wt.%) | 1-liter rocked Parr autoclave Three 1.5 cm diameter stainless steel balls for added agitation. Ash wt. %[b] Before | After |
|---|---|---|---|
| 32 | Benzene | 13.4 | 22.7 |
| 33 | 88% Benzene-12% cresol[a] | 13.4 | 34.7 |
| 34 | 75% Benzene-25% cresol[a] | 13.4 | 37.2 |
| 35 | 50% Benzene-50% cresol[a] | 13.4 | 49.2 |
| 36 | 75% Benzene-25% cresol | 20.8 | 54.7 |

[a]Cresol composition of cresol: 48.9% m-cresol; 11.3% p-cresol; 24.0% 2,4-dimethyl phenol; 7.8% 3,4-dimethyl phenol; and 7.8% catechol (by weight).
[b]Feed A containing 20.8 weight percent mineral ash was obtained from the catalytic conversion of Illinois No. 6 coal. Feed B containing 13.4 weight percent mineral ash was obtained from the noncatalytic conversion of blends of Kentucky No. 9 and 14 coals.

What is claimed is:

1. In a process which comrises preparing coal liquefaction products by contracting coal with coal dissolving solvent at elevated temperature and pressure in a hydrogen atmosphere, passing the resulting mixture to a vaccum tower to remove coal dissolving solvent for recirculation and leave still bottoms substantially free of such coal dissolving solvent, the improvements which comprise contacting said vacuum tower still bottoms, which are substantially free of coal dissolving solvent, with a solubilizing solvent to dissolve a substantial quantity of said still bottoms and separating said dissolved still bottoms from undissolved still bottoms.

2. A process as set forth in claim 1 in which the solubilizing solvent is separated from the undissolved still bottoms.

3. A process as set forth in claim 1 in which the solubilizing solvent is separated from the undissolved still bottoms and is recycled for contact with fresh vacuum tower still bottoms.

4. A process as set forth in claim 1 in which the dissolved still bottoms are separated from the undissolved still bottoms by settling.

5. A process as set forth in claim 1 in which the dissolved still bottoms are separated from the undissolved still bottoms by countercurrent decantation.

6. A process as set forth in claim 1 in which the dissolved still bottoms are separated from the undissolved still bottoms by filtration.

7. A process as set forth in claim 1 in which the still bottoms and solubilizing solvent are contacted for up to about 2 hours at a temperature of from about 190° F to about 400° F.

8. A process as set forth in claim 1 in which solubilizing solvent is recovered from the dissolved still bottoms.

9. A process as set forth in claim 1 in which solubilizing solvent is recovered from the dissolved still bottoms and recycled for contact with fresh vacuum tower still bottoms.

10. A process as set forth in claim 1 in which the undissolved still bottoms are treated to recover the carbon and hydrogen values therefrom.

* * * * *